United States Patent [19]

Hinden et al.

[11] 4,444,642

[45] Apr. 24, 1984

[54] DIMENSIONALLY STABLE COATED ELECTRODE FOR ELECTROLYTIC PROCESS, COMPRISING PROTECTIVE OXIDE INTERFACE ON VALVE METAL BASE, AND PROCESS FOR ITS MANUFACTURE

[75] Inventors: Jean M. Hinden, Chambésy, Switzerland; Henri B. Beer, Heide Kalmthout, Belgium

[73] Assignee: Diamond Shamrock Corporation, Dallas, Tex.

[21] Appl. No.: 293,382

[22] Filed: Aug. 17, 1981

[30] Foreign Application Priority Data

Aug. 18, 1980 [GB] United Kingdom ..... 8026831
Apr. 6, 1981 [GB] United Kingdom ..... 8110759

[51] Int. Cl.[3] ..... C25B 11/16; C25B 11/10

[52] U.S. Cl. ..... 204/290 F; 427/126.3; 427/126.5; 502/101

[58] Field of Search ..... 204/290 K, 290 F; 252/425.3; 427/126.3, 126.5

[56] References Cited

U.S. PATENT DOCUMENTS 3,616,302 10/1971 Osawa et al. ..... 204/40
3,711,385 1/1973 Beer ..... 204/59
4,118,294 10/1978 Pellegri ..... 204/129

FOREIGN PATENT DOCUMENTS 2723406 12/1977 Fed. Rep. of Germany ... 204/290 K
2714605 10/1978 Fed. Rep. of Germany ... 204/290 K
49-40050 10/1974 Japan ..... 204/290 K
51-70187 6/1976 Japan ..... 204/290 K

OTHER PUBLICATIONS

Kokhanov et al., Translation of Elektrokhimiya, vol. 9, No. 1, pp. 30–33, 1/73.

*Primary Examiner*—F. Edmundson
*Attorney, Agent, or Firm*—Arthur S. Collins; Bruce E. Harang; John P. Hazzard

[57] ABSTRACT

An electrode for use in an electrolytic process is provided with a mixed oxide interface between a titanium base and an outer coating. The mixed oxide is formed at said interface by means of titanium from the base and noble metal from a solution containing a predetermined amount of HCl which attacks the titanium base surface. Slow drying provides a metal chloride mixture which is thermally converted to said mixed oxide of titanium and noble metal in a given ratio, whereby to protect the titanium base from oxidation.

An outer coating of manganese dioxide or lead dioxide is electroplated on the mixed oxide layer so as to provide an inexpensive electrode with improved resistance to oxidation.

This electrode can be used for various processes where a high resistance to oxidation is required, e.g. as a manganese dioxide anode in a metal electrowinning process or as a lead dioxide anode for electroflotation or organic oxidation reactions.

9 Claims, No Drawings

DIMENSIONALLY STABLE COATED ELECTRODE FOR ELECTROLYTIC PROCESS, COMPRISING PROTECTIVE OXIDE INTERFACE ON VALVE METAL BASE, AND PROCESS FOR ITS MANUFACTURE

FIELD OF INVENTION

The invention generally relates to electrodes for electrolytic processes and the manufacture of such electrodes comprising an outer coating for effecting an electrolytic process, a protective intermediate oxide layer and a valve metal base.

BACKGROUND ART

Electrodes for use in industrial electrolysis cells must generally meet a combination of strict requirements with regard to conductivity, physical and chemical stability, corrosion resistance, manufacture and electrochemical performance, more particularly catalytic activity and selectivity.

However, there is no known material which can meet all of these requirements for satisfactory performance of industrial electrodes. The very few materials which are able to withstand severe anodic attack can generally not be used alone to produce electrodes with adequate electro-chemical performance under industrial operating conditions. Consequently, various types of composite electrodes comprising different combinations of materials have been proposed, in order to be able to meet as far as possible the various technical and economic requirements for providing adequate industrial performance.

Various types of electrodes comprising a catalytic coating on a metal base have been proposed, as may be seen from the numerous patents relating to such electrode coatings.

An outstanding success in this field is the dimensionally stable anode, known under the tradename DSA and described e.g. in U.S. Pat. No. 3,632,498, which comprises a catalytic coating consisting of titanium-ruthenium oxide formed on a titanium base, and which has fundamentally changed the chlorine industry throughout the world in the past decade.

An electrode base of titanium is preferred because titanium and other suitable valve metals can exhibit extremely high corrosion resistance due to their film forming properties whereby a protective oxide film is formed under anodic operating conditions.

Platinum group metals are known to provide excellent electrocatalysts for different electrode reactions but their high cost makes it necessary to use them as sparingly as possible, and more particularly to replace them by cheaper electrode materials whenever possible. Ruthenium is of particular interest due to its relatively low cost and availability with respect to the other platinum group metals.

The dimensionally stable anode (DSA) mentioned above exhibits excellent, stable performance with a long service life in chlorine production cells. This DSA must, however, be manufactured and operated under controlled conditions in order to avoid the formation of an insulating titanium oxide layer on the electrode base, which would result in electro-chemical passivation of the anode with an excessive rise of its operating potential.

Another anode, as described e.g. in U.S. Pat. No. 3,776,834 comprises a catalytic coating with tin replacing about one half of the ruthenium normally contained in the standard coating of the titanium-ruthenium oxide of said DSA. This anode with partial replacement of ruthenium by tin exhibits a higher oxygen overvoltage and an improved resistance to oxidation in presence of anodically generated oxygen than the standard DSA currently used in the chlor-alkali industry.

Various inexpensive electrode materials based on non-noble metals have been proposed but their use has nevertheless remained relatively restricted for various reasons.

Lead dioxide is also a promising stable, inexpensive anode material for various processes, but massive lead dioxide anodes exhibit inadequate conductivity. On the other hand, lead dioxide coatings formed on an electrode base have generally not provided satisfactory stable performance with a high service life in industrial operation. The state of the art relating to lead dioxide electrodes, their manufacture, and use, may be illustrated by U.S. Pat. Nos. 4,040,039, 4,026,786, 4,008,144, 3,751,301, 3,629,007 and U.K. Pat. Nos. 1,416,162, 1,378,884, 1,377,681.

Manganese dioxide also shows great promise as a stable, inexpensive anode material, especially for oxygen evolution in processes for electrowinning metals from acid solutions. Its widespread use has nevertheless been hindered hitherto by manufacturing difficulties: the manufacture of satisfactory massive electrodes consisting entirely of manganese dioxide has not been possible, while manganese dioxide coatings formed on an electrode base have generally not provided satisfactory stable performance with a high industrial service life.

Lead dioxide and manganese dioxide coatings may be produced by thermal decomposition of metal salts deposited on the electrode base forming the coating substrate, but the resulting oxide coating is nevertheless generally quite porous and has poor adherence to the base. On the other hand, more compact oxide coatings with better adherence may be produced by electrodeposition on the electrode base, but they are nevertheless porous and generally still provide inadequate protection of the electrode base from oxidation.

It has moreover been proposed to provide the metal electrode base with an intermediate protective coating which is covered with an outer coating of lead or manganese dioxide. The state of the art relating to such intermediate protective coatings may be illustrated by U.S. Pat. Nos. 4,028,215, 4,125,449, 4,040,937 (Sn/Sb oxide subcoating); Japanese Patent Application No. 51-156740, publication No. 53-79771 and Electrochimica Acta Vol. 23, p. 331–333 (Pt Group metal oxide subcoating); U.S. Pat. No. 4,072,586 ($RuO_2/TiO_2$ subcoating); U.S. Pat. No. 4,180,445 ($TiO_2/SnO_2/RuO_2$ subcoating); and U.S. Pat. No. 4,060,476 (TiN subcoating).

Such intermediate protective coatings must form an effective barrier against oxidation of the electrode base and must meet various requirements for this purpose with regard to adherence, conductivity, cost, impermeability, resistance to oxidation, physical and chemical stability. This particular combination of properties is nevertheless difficult to achieve in industrial practice.

Various proposals have also been made to use polymeric materials in the production of electrodes. Thus, for example, according to U.S. Pat. No. Re. 29419, a catalytic composite coating formed on a valve metal base, comprises ruthenium dioxide finely dispersed in an organic polymer intended to serve as a binder for mechanical support of the dispersed electrocatalyst, adhesion to the underlying base, and protection thereof. The ruthenium dioxide is prepared in the form of extremely fine particles of less than 0.1 micron size and uniformly dispersed in the polymer in a weight ratio of 6:1 to 1:1 to provide the electrical and catalytic properties of the coating. The conductivity of such a composite coating will thus depend essentially on the amount of dispersed electrocatalyst, on its particle size and on its distribution in the polymer (binder). The state of the art relating to electrodes comprising polymeric materials may further be illustrated by U.S. Pat. Nos. 3,626,007, 3,751,301, 4,118,294, 3,972,732, 3,881,957, 4,090,979 and the laid-open German Patent Application, Offenlegungschrift No. 2 035 918.

The service life of coated electrodes such as those mentioned above is nevertheless generally limited when they are operated industrially in presence of a notable anodic generation of oxygen. A particular problem in this connection is that of ensuring adequate protection of the electrode base from attack by oxidation leading to electrode failure due to corrosion or electrochemical passivation of the base.

It may thus be seen from the foregoing that, in addition to the choice of suitable electrode materials, the production of electrodes with satisfactory, long-term performance in industrial electrolytic processes is generally quite problematic and presents complex technological problems.

DISCLOSURE OF INVENTION

An object of this invention is to provide electrodes for electrolytic processes, which comprise a valve metal base, a stable outer coating for effecting an electrolytic process, and an intermediate layer which ensures satisfactory protection of the electrode base from oxidation, which adheres well to said base, to which said outer coating adheres well, and which remains stable, under the industrial operating conditions for which the electrode is intended.

Another object of the invention is to provide such electrodes with a protective intermediate layer which can be formed on the electrode base without difficulty, and which allows the outer coating to be subsequently manufactured in a satisfactory manner without any deterioration of the electrode base.

A further object of the invention is to provide such an electrode with an improved oxidation resistance, a long service life and stable electrochemical performance under industrial operating conditions.

A further object of the invention is to provide an electrode with a valve metal base which is protected from passivation by means of such an intermediate layer containing a platinum group metal in an amount which is reduced as far as possible and advantageously corresponds to less than 2 $g/m^2$ of the electrode base, and preferably to less than 1 $g/m^2$.

Another object of the invention is to provide such electrodes with a minimum overall amount of precious metal incorporated in the electrode.

A further object of the invention is to provide an electrode with such a protective intermediate layer and a catalytic outer coating of manganese dioxide.

Another object of the invention is to provide an electrode with such a protective intermediate layer and an outer coating of lead dioxide.

A further object of the invention is to provide a simple manufacturing process for the production of electrodes with such a protective intermediate layer.

Another object of the invention is to allow the production of electrodes with satisfactory long-term performance, comprising a valve metal base with said protective intermediate layer and an inexpensive, stable, electroplated outer coating of any desired thickness, for carrying out an electrolytic process, more particularly involving anodic evolution of oxygen.

The above mentioned objects are essentially met by the invention as set forth in the claims.

The invention essentially provides electrodes having a valve metal base with a very thin protective oxide layer formed at the interface between the base and a subsequently deposited outer coating, more particularly an electroplated coating.

Said protective oxide layer is formed by converting valve metal from the surface of the electrode base into a mixed oxide which is integrated in the base surface said oxide layer consisting of a mixed oxide of said valve metal and a noble metal selected from the group consisting of iridium, rhodium and ruthenium.

Said mixed oxide is formed by effecting a special oxidation surface treatment of the valve metal base under carefully controlled conditions, in accordance with the method set forth in the claims.

The valve metal base used in accordance with the invention may be any suitable electrode base consisting essentially of a valve metal such as titanium, zirconium, tantalum, niobium, or of a valve-metal based alloy, or at least comprising such a valve metal or alloy at the surface of the base to provide a valve metal substrate for forming the mixed oxide layer according to the invention.

The solution applied to the base must contain a sufficient amount of hydrogen chloride to attack the base surface, to thereby convert the valve metal thereon to a corresponding chloride mixed with the noble metal chloride applied with the solution, and to thereby provide a chloride mixture for thermal conversion to the mixed oxide. The amount of valve metal from the base which is converted to chloride will evidently depend on one hand on the HC1 concentration in said solution and on the other hand on the time available for such a conversion. Consequently, the applied solution should be dried slowly without any significant elevation of temperature, so as to provide the time necessary for conversion to the valve metal chloride. In addition, the applied solution should properly wet the base surface in order to ensure said conversion of the valve metal thereon.

The invention was successfully carried out with isopropylalcohol as a solvent for the applied solution, although other alcohol solvents such as ethanol and butanol were likewise used successfully. On the other hand, water is apparently unsuitable as a solvent for carrying out the invention. This may be due to insufficient wetting of the valve metal by the water based solution and/or to too rapid evaporation of the hydrochloric acid.

The HCl concentration required to provide a given molar ratio of the valve metal to noble metal converted to a mixed oxide may be theoretically calculated. However, some excess HCl will generally be provided to ensure the required conversion. Moreover, in order to be able to ensure the formation of a mixed oxide integrated in the valve metal base surface in accordance with the invention, the molar ratio of HCl to noble metal chloride present in the applied solution must be kept within given ranges. This molar ratio will depend in each case on the desired ratio of valve metal to noble metal in the mixed oxide to be formed, as well as the amount of valve metal which can be effectively converted to chloride in practice, and more particularly on the amount of HCl which can reach and effectively attack the valve metal surface. It may moreover be noted in this connection that the number of layers of solution which may be applied and thermally converted to a mixed oxide according to the invention will depend on various factors, and more especially on the concentration of noble metal in the applied solution in each case.

The invention was carried out successfully with iridium chloride ($IrCl_3$) dissolved in isopropyl alcohol in a concentration corresponding to about 7 grams of iridium metal per liter. Mixed oxides were also formed according to the invention with iridium concentrations from 3.5 g/l to 35 g/l. The noble metal chloride concentration may nevertheless be selected in a still broader concentration range from about $1\times10^{-2}$ mole per liter of solution, although the narrower ranges of $2\times10^{-2}$ to $10\times10^{-2}$ and especially $2.5\times10^{-2}$ to $7.5\times10^{-2}$ moles per liter are preferred to ensure satisfactory mixed oxide formation in accordance with the invention.

However, as already indicated above, the concentration of HCl should in each case be selected according to the concentration of the noble metal chloride present in the applied solution, so that their molar ratio lies within a given range to provide satisfactory formation of a mixed oxide. The HCl concentration may thus also be selected from a relatively broad range, from about $14\times10^{-2}$ to about 3 mole HCl per liter, but the selected value will depend in each case on the selected concentration of noble metal chloride present in the solution applied when carrying out the invention.

The previously mentioned range of molar ratios of HCl to noble metal chloride concentration may extend between 1:1 and 100:1, and preferably between 3:1 and 30:1 when carrying out the present invention, but both concentrations must be increased or decreased at the same time.

It has been established that the formation of mixed oxide according to the invention is not possible when the HCl concentration is exceedingly high, e.g. 200 g/l and the noble metal concentration is exceedingly low, e.g. 2–3 g/l, and that in this case no useful results are achieved with regard to providing an electrode with adequate long term performance.

On the other hand, as may be seen from the examples given further on, excellent performance as an anode for oxygen evolution is achieved when said molar ratio is selected within said given range in accordance with the invention.

The chloride mixture obtained according to the invention by applying a solution containing hydrogen chloride and noble metal chloride in given proportions, and slowly drying the applied solution, is converted to a mixed oxide by subjecting said mixture to heat treatment in an oxidizing atmosphere at a relatively high temperature lying in the range from 400° C. to 600° C., more particularly in the range from about 450° C. to about 520° C. This heat treatment provided satisfactory conversion to a mixed oxide at a temperature of about 480° C. for about 5–10 minutes in air flow, but treatment at a lower temperature may require a longer time and vice-versa. On the other hand, heat treatment at a relatively low temperature below 400° C. for a relatively long period of 1 hour did not provide satisfactory results.

The duration and temperature of said heat treatment should thus be mutually adapted in each case so as to ensure satisfactory conversion of said chloride mixture to a mixed oxide, while avoiding an undesirable oxidation of the underlying valve metal of the base.

In accordance with the invention, the sequence of steps, comprising: applying a solution of suitable, controlled composition, slowly drying, and controlled heat treatment for conversion of the chloride mixture to a mixed oxide should be carried out cyclically several times, namely at least twice, so as to gradually form a mixed oxide of adequate thickness, containing a sufficient amount of noble metal.

The first layer of mixed oxide thus formed will be relatively porous, thus allowing the solution subsequently applied to penetrate this first porous layer, to thereby attack the underlying valve metal for further conversion to a corresponding valve metal chloride, whereby to additionally form said chloride mixture for further conversion to a mixed oxide, which is thus formed partly within the pores of the first layer.

The porosity of the resulting mixed oxide layer is thus gradually reduced each time the said cycle of steps for forming a mixed oxide is repeated, until no more valve metal from the base can be effectively converted to chloride and hence to the mixed oxide.

Any further repetition of said cycle of steps would no longer allow the formation of a mixed oxide according to the invention, and would moreover be undesirable, since it would lead to the formation of a simple noble metal oxide which, as is well known, is much less stable than a mixed oxide comprising a significant amount of valve metal.

An extremely stable, homogeneous relatively compact and impermeable electro-conducting mixed oxide may thus be gradually obtained from the valve metal base by cyclically repeating a sequence of simple, well-controlled steps in accordance with the invention. However, as already indicated, the amount of mixed oxide which can thus be formed according to the invention is limited in each case, while further application of the solution should in fact be avoided since it would lead to undesirable formation of a less stable oxide. The number of layers of solution which can be effectively applied so as to allow formation of a mixed oxide according to the invention will largely depend on the noble metal concentration in the solution applied in each case. Thus, for example, a solution comprising $IrCl_3$ corresponding to 7 g Ir/liter of solution provided excellent results when said sequence of steps for forming a mixed oxide were repeated 4 times according to the invention. However, the number of repetitions of said sequence of steps may be increased up to 20 times or possibly more, especially in such cases where the noble metal concentration in the applied solution is significantly reduced so as to approach the lower limit of the corresponding concentration range given above.

On the other hand, when relatively high noble metal concentrations are used, the number of times the solution is applied will have to be reduced to e.g. between 2 and4, in order to allow formation of a mixed oxide only, as well as to avoid a prohibitively high loading of the valve metal base surface with noble metal in the form of a relatively unstable mixed oxide comprising a reduced proportion of valve metal. It may further be noted that the solution for forming a mixed oxide according to the invention may be applied by any suitable means such as a brush or spraying device for example.

As regards the amount (v) of solution which may be applied each time, good results were obtained according to the invention by applying 10–20 ml of said solution per square meter of the valve metal base surface. Moreover 50 ml/m$^2$ could also be applied by spraying, while as little as 5 ml/m$^2$ may possibly by applied. The total loading (L) of noble metal incorporated in the form of a mixed oxide per unit area of the surface of the valve metal base, will evidently be proportional to the noble metal concentration ($C_{NM}$) is the applied solution, the number (N) of times it is applied, and the amount of solution (v ml/m$^2$) applied each time. Good results were obtained by means of the invention with noble metal loadings (L) corresponding to 0.5–1 gram noble metal in the form of a mixed oxide per unit surface area of the valve metal base. Although a satisfactory result may be achieved with a noble metal loading somewhat lower than 0.5 g/m$^2$, this value is already so low that a further reduction would hardly provide any further significant economic advantage.

On the other hand, it was found that extremely low noble metal loadings of about 0.2 g/m$^2$ did not provide satisfactory results with a reasonable number (N) of applications of the solution.

It was moreover found that the noble metal loading may be somewhat increased above 1 g/m$^2$, for example to 1.2 g/m$^2$ or possibly up to about 1.5 g/m$^2$ in some cases, if desired.

It is thus apparent from the foregoing explanations that a reasonable compromise should be found for the abovementioned parameters within the corresponding indicated ranges, so as to provide the best result according to the invention, depending on the particular electrode requirements in each case. Thus for example, the number of applications of the solution, followed each time by drying and heat treatment should evidently be kept within reasonable limits. This number of applications should on one hand be increased to provide all of the advantages of the invention, whereas an excessively high number of applications is undesirable as being too onerous, while also not fully providing all of the advantages of the invention.

Large electrodes for industrial use could moreover be manufactured without difficulty in accordance with the invention, namely by following the special teachings of the invention for forming a mixed oxide by means of, on one hand, valve metal provided by the electrode base itself, and on the other hand, noble metal provided by the applied solution.

As may be seen further on, the mixed oxide which is thus "grown" from the valve metal base and thereby completely integrated in the surface of the electrode base can provide excellent protection of the valve metal base by means of a relatively low noble metal loading, while presenting a practically negligible electrical resistance, so as to thereby provide, in a quite simple and economical manner, an excellent electro-conducting intermediate substrate for the subsequent electrodeposition of a stable, inexpensive outer coating, consisting particularly of manganese or lead dioxide.

This intermediate mixed oxide substrate thus formed in accordance with the special teachings of the invention moreover provides not only excellent protection and a low potential drop, but also improved electrodeposition with excellent bonding of the electroplated coating to the valve metal base. This excellent bond in turn provides an improvement of the quality and performance of the resulting electrode, and hence a considerable improvement of its long-term performance and service life.

BEST MODE OF CARRYING OUT INVENTION

The manufacture of electrodes in accordance with the invention is illustrated by the following examples with reference to the tables below.

These tables show the references, loadings of noble metal (NM) in said mixed oxide and of the oxide in the outer coating (TC), as well as test data for the respective samples, namely anode current density ACD, anode potential AP versus a normal hydrogen electrode NHE, and the test duration. The test duration in hours, given in the last column in the tables, is underlined when the anode failed, and marked with an asterisk when it was still operating.

EXAMPLE 1

Electrode samples with a manganese dioxide coating on a titanium base were prepared in the following manner.

Titanium plates (10×2 cm) were degreased, rinsed in water, dried and etched for 30 minutes in oxalic acid.

The titanium plate surface was then treated by applying a fresh solution S6 comprising: 10 ml isopropanol (IPA), 0.06 ml HCl, 0.16 g $IrCl_3$ aq. (48 wt.% Ir) with a brush to the pretreated titanium plates and drying slowly in air. A heat treatment was then effected at 480° C. for 7 minutes in an air flow of 60 l/h in order to produce a mixed oxide of titanium and iridium at the base surface.

This sequence of applying solution, drying and heat treatment was repeated four times (five times for CHl), so as to gradually form a mixed oxide layer consisting titanium from the base and given amount of iridium and to thereby provide a mixed oxide intermediate substrate for electroplating.

This mixed oxide substrate was then topcoated by anodically depositing manganese dioxide generally at a current density of 1.5 mA/cm$^2$ for 1.5 hours, from a 2M manganese nitrate bath at a temperature of 90°–95° C., for SM3 at 10 mA/cm$^2$ for 3 hours, and for SM2 and D40b at 20 mA/cm$^2$ for 1.5 hours. The $MnO_2$ topcoating was finally heat treated at 400° C. for 20 minutes in an air flow at 60 l/h to improve the electrode performance.

The resulting electrode samples coated with $MnO_2$ were finally subjected to accelerated testing as an oxygen evolving anode, at a fixed anode current density (ACD) lying in the range of 500–7500 A/m$^2$, in an electrolytic cell containing 150 g/l $H_2SO_4$ at 45°–55° C. The initial anode potential AP of each sample tested was determined with respect to a normal hydrogen electrode (V/NHE), but without correction for ohmic drop. The final potential at the end of the test period was also determined, except when the anode potential underwent a sudden, steep rise, corresponding to anode failure.

It may be noted that the preparation of electrode samples Mel, C49 and B03 in Table 1 differed from that described above in that the titanium substrate of Mel was etched with HCl (instead of oxalic acid), while the $MnO_2$ topcoating of B03 was heat treated at 330° C. (instead of 400° C.), and that of C49 at 400° C. but in static air.

Electrode sample CHl was removed from the test cell after 1000 hours of stable operation at 7500 A/m$^2$ and was then subjected to X-ray diffraction (XRD) analysis, which showed that about 75–80% of the original $\beta$-$MnO_2$ coating still remained, without having undergone any notable structural change.

TABLE 1

| REFERENCE | Loading g/m$^2$ Ir | Loading g/m$^2$ $MnO_2$ | Electrolytic Test ACD A/m$^2$ | Electrolytic Test AP V/NHE | Electrolytic Test DURATION (h) |
|---|---|---|---|---|---|
| B96 | 0.5 | 320 | 500 | 1.64 | 13500 |
| B37 | 0.5 | 400 | 1.75–1.90 | 15945* | |
| B03 | 0.5 | 390 | 2500 | 1.94 | 400 |
| Me2 | 0.5 | 381 | 4500 | 1.94 | 1640 |
| SM1 | 0.5 | 418 | 4500 | 1.86 | 2000 |
| Me1 | 0.5 | 424 | 4500 | 1.87 | 1360 |
| D40a | 0.5 | 493 | 4500 | 1.95 | 2000 |
| SM3 | 0.5 | 360 | 4500 | 2.00 | 680 |
| SM2 | 0.5 | 328 | 4500 | 1.90 | 1550 |
| D45 | 0.5 | 395 | 7500 | 1.94 | 785 |
| SM7 | 0.5 | 410 | 7500 | 1.97 | 913 |
| D49 | 0.5 | 260 | 7500 | 1.94 | 253 |
| D40b | 0.5 | 200 | 7500 | 1.95 | 420 |
| CH1 | 0.9 | 400 | 7500 | 1.95 | 1000* |

EXAMPLE 2

Comparative samples B65, F12 and SM5, were provided with a mixed oxide substrate in the manner described in Example 1. However, instead of electrodepositing the $MnO_2$ topcoating, it was formed in this case, for purposes of comparison, by thermal decomposition of manganese nitrate applied in solution to the mixed oxide surface layer.

Table 2 gives the corresponding data for all these samples in the same manner as in Table 1.

A comparison of the results given in Tables 1 and 2 shows that higher lifetimes under similar conditions were achieved with the electroplated manganese dioxide coatings of Example 1.

TABLE 2

| REFERENCE | Loading g/m$^2$ Ir | Loading g/m$^2$ $MnO_2$ | Electrolytic Test ACD A/m$^2$ | Electrolytic Test AP V/NHE | Electrolytic Test DURATION (h) |
|---|---|---|---|---|---|
| B65 | 0.5 | 400 | 500 | 1.86 | 6200 |
| F12 | 0.5 | 360 | 7500 | 2.02 | 230 |
| SM5 | 0.5 | 400 | 7500 | 1.96 | 350 |

EXAMPLE 3

Electrode samples with a lead dioxide coating on a titanium mesh base were prepared in the following manner.

Titanium mesh coupons (50×25×2 mm) were pretreated by grit-blasting and etching in 25% HCl at 96° C. for 30 minutes.

A solution was prepared by dissolving 1 g $IrCl_3$ aq. (56% Ir) in 60 ml n-butyl alcohol and 3 ml 36% HCl. The surface of the pretreated titanium mesh was then treated by applying this solution uniformly with a brush, drying for 10 minutes in air and baking for 7 minutes at 480° C. in a stream of air.

This surface treatment was repeated 4 times so that the titanium surface was gradually converted to a mixed oxide substrate containing 0.5 g Ir/m$^2$.

Lead dioxide was next electroplated onto the resulting mixed oxide substrate from a plating bath consisting of an aqueous solution comprising 400 g/l $Pb(NO_3)_2$, 14 g/l $Cu(NO_3)_2$, 10 g/l $HNO_3$, and 12 g/l surfactant (Triton-X, Trademark). Lead dioxide was anodically deposited from this bath at 50°–75° C. in two successive stages, first for 5 minutes at 40 mA/cm$^2$, and then for 55 minutes at 20 mA/cm$^2$. After drying at 100° C. for 5 minutes, a lead dioxide coating was obtained with a loading corresponding to about 1000 g $PbO_2$/m$^2$. The electroplating cell voltage was about 1.5 V and the current efficiency for $PbO_2$ was 50%.

The resulting titanium mesh sample (51) topcoated with lead dioxide on an intermediate mixed oxide substrate surface was subjected to an accelerated test as an oxygen evolving anode at 8000 A/m$^2$ in 150 g/l $H_2SO_4$ at 50° C. It exhibited an initial single electrode potential of 2.26 V vs. NHE (Normal Hydrogen Electrode), without correction for ohmic drop. This test was interrupted when the cell voltage rose to above 5 V (initial about 4.5 V) and the anode lifetime under these accelerated test conditions was about 680 hours.

TABLE 3

| REFERENCE | Loading g/m$^2$ Noble Metal | Loading g/m$^2$ $PbO_2$ | Electrolytic Test ACD A/m$^2$ | Electrolytic Test AP V/NHE | Electrolytic Test DURATION (h) |
|---|---|---|---|---|---|
| 51 | 0.5 Ir | 996 | 8000 | 2.26 | 680 |
| A | 0.8 Ir | 1700 | 7500 | 2.38 | 800 |
| B | 0.8 Ir | 1570 | 7500 | 2.25 | 780 |
| C | 0.8 Ir | 1460 | 4500 | 2.20 | 4035 |
| D | 0.8 Ir | 1430 | 2500 | 2.15 | 5665* |
| E | 0.8 Ir | 1580 | 7500 | 2.29 | 780 |
| F | 0.2 Ir 0.6 Ru | 1810 | 7500 | 2.55 | 150 |

EXAMPLE 4

Electrode samples A-F with a lead dioxide coating on a titanium plate base were prepared in the following manner.

Titanium plate coupons (100×20×1 mm) were pretreated by grit-blasting and etching in 15% HCl at 100° C. for 60 minutes.

A solution was prepared by dissolving 0.1 g $IrCl_3$ aq. (48% Ir) in 6 ml isopropyl-alcohol and 0.4 ml 36% HCl. The surace of the pretreated titanium samples was then treated by applying this solution uniformly with a brush, drying for 5 min. in air at 60° C. and baking for 7.5 minutes at 480° C. in a stream of air. This surface treatment was repeated 4 times, so that the titanium surface was gradually coverted to an oxide substrate containing 0.8 g Ir/m$^2$.

Lead dioxide was next electroplated onto the resulting oxide substrate from the same bath as in Example 1, but in a single stage at 20 mA/cm$^2$ during 2 hours. Drying was then effected at 120° C. for 120 minutes and the lead dioxide coatings thus obtained had a loading corresponding to 1430 to 1700 g $PbO_2$/m$^2$ of the substrate surface. One sample (A) was further treated at 400° C. for 20 minutes. Four electrode samples (A to D) thus produced were subjected to an accelerated test as oxygen evolving anodes in 150 g/l $H_2SO_4$ at 45° C. The previous table shows the lead dioxide loading, anode test current density and test duration for 4 anode samples A to D according to this example.

Electrode sample (E) prepared as described, was submitted to an accelerated test under the same conditions as sample A, except that 10 ppm sodium fluoride was added to the sulphuric acid electrolyte. No detrimental effect of the fluoride ions was detected under these conditons.

Another sample (F) was prepared in the same manner, except that a part of the iridium chloride was replaced by ruthenium chloride in the solution so as to get a mixed oxide substrate surface with an overall noble metal loading of 0.2 $g/m^2$ Ir plus 0.6 $g/m^2$ Ru.

It was further topcoated with lead dioxide and anodically tested. It has an anode life of 780 hours under accelerated test conditions at 7500 $A/m^2$.

INDUSTRIAL APPLICABILITY

Electrodes produced in accordance with the invention may be advantageously applied to various electrolytic processes where inexpensive, stable, oxidation-resistant electrodes with a valve metal base are required.

They may be advantageously applied as anodes intended for operation under conditions where oxygen is anodically evolved, more particularly in acid electrolyte.

Electrodes according to the invention, which have a manganese dioxide coating, may be advantageously applied as inexpensive oxygen evolving anodes of reduced weight and volume operating at a reduced voltage with no contamination of the electrolyte, and hence may be advantageously used, instead of conventional lead or lead alloy anodes currently employed, in processes for electrowinning metals such as Cu, Zn, Co, Ni, Cr from acid electrolytes.

Electrodes according to the invention which have a lead dioxide coating may be advantageously used as insoluble anodes for electrolysis in aqueous solution containing organic substances, fluoride, chloride, bromide, chlorate, sulfate, nitrate, cyanide, carbonate, $C_2H_3O_2$, chromate, bichromate. They may be used in processes for the recovery, refining and electrowinning of metals such as Cu, Zn, Co, Ni, Cr. They may also be usefully applied in processes for chromic acid production, chromium plating, perborate, persulfate, or perchlorate production, oxidation of iodic acid. They may likewise be usefully applied as anodes for electroflotation, or for organic oxidation reactions requiring a relatively high oxygen overvoltage.

We claim:

1. A method of manufacturing an anode for use in an electrolytic process, comprising a valve metal base and an outer coating of lead dioxide or manganese dioxide characterized by the steps of:

(a) converting valve metal in the surface of said valve metal base into a protective layer of electrically conducting mixed oxide integrated with said surface by:

(i) applying to said surface a solution containing 0.14 to 3.0 moles per liter of hydrogen chloride and 0.02 to 0.10 mole per liter noble metal chloride selected from chlorides of iridium, rhodium and ruthenium, said concentrations being selected to provide a molar ratio of hydrogen chloride to noble metal chloride of between about 3:1 and about 30:1;

(ii) drying said solution on said surface slowly to achieve substantial reaction between said hydrogen chloride and said surface, thereby forming on said surface an intimate mixture of the valve metal chloride and the noble metal chloride in proportions consonant with said molar ratio;

(iii) heating the thus treated valve metal base from (ii) in an oxidizing atmosphere at 400° C. to 600° C. until said intimate mixture has been converted into an electrically conducting mixed oxide integrated with the surface of said base;

(iv) repeating this sequence of steps (i) through (iii) until enough of said conductive mixed oxide has been integrally grown on said surface to provide a protective layer for said valve metal base; and (b) applying an outer coating of lead dioxide or manganese dioxide onto said protective layer of electrically conducting mixed oxide.

2. A method as in claim 1 wherein said outer coating is formed of manganese dioxide.

3. A method as in claim 1 wherein said outer coating is formed of lead dioxide.

4. The method of claim 1, 2, or 3, characterized in that said outer coating is electrodeposited in an amount corresponding to at least 100 grams per square meter of the valve metal base surface.

5. The method of claim 1, 2, or 3, characterized in that said chloride mixture is heat treated in a temperature range from about 450° C. to about 520° C.

6. The method of claim 1, 2, or 3, characterized in that said noble metal chloride molar concentration is between $2.5\times10^{-2}$ and $7.5\times10^{-2}$ mole per liter.

7. The method of claim 1, 2, or 3, characterized in that said solution applied to the valve metal base surface comprises a non-aqueous solvent which slowly evaporates during the drying step while leaving the hydrochloric acid in contact with said surface for a sufficient time to provide for conversion of the valve metal to the corresponding chloride.

8. The method of claim 7, characterized in that said solvent is alcohol.

9. The method of claim 7, characterized in that said solvent is isopropylalcohol.

* * * * *